US010180290B2

(12) United States Patent
Bry et al.

(10) Patent No.: US 10,180,290 B2
(45) Date of Patent: Jan. 15, 2019

(54) HEADER FOR A HEAT EXCHANGER OF A MOTOR VEHICLE

(71) Applicant: Valeo Systemes Thermiques, Le Mesnil-Saint-Denis (FR)

(72) Inventors: Samuel Bry, Parne sur Roc (FR); Patrick Boisselle, Laval (FR); Erwan Etienne, Laval (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 0 days.

(21) Appl. No.: 15/308,851

(22) PCT Filed: May 5, 2015

(86) PCT No.: PCT/EP2015/059865
§ 371 (c)(1),
(2) Date: Nov. 4, 2016

(87) PCT Pub. No.: WO2015/169807
PCT Pub. Date: Nov. 12, 2015

(65) Prior Publication Data

US 2017/0074601 A1 Mar. 16, 2017

(30) Foreign Application Priority Data

May 5, 2014 (FR) ..... 14 54042

(51) Int. Cl.
*F28F 1/32* (2006.01)
*F28F 9/02* (2006.01)
(Continued)

(52) U.S. Cl.
CPC ..... *F28F 9/0226* (2013.01); *F28F 1/02* (2013.01); *F28F 21/062* (2013.01);
(Continued)

(58) Field of Classification Search
CPC ..... F28F 1/00; F28F 3/12; F28F 9/00; F28F 9/005; F28F 9/007; F28F 9/02;
(Continued)

(56) References Cited

U.S. PATENT DOCUMENTS 3,415,315 A * 12/1968 Donaldson ..... F28F 9/001 165/148
4,289,507 A * 9/1981 Cadars ..... F01P 11/02 165/104.32
(Continued)

FOREIGN PATENT DOCUMENTS

EP 0 022 235 A2 1/1981
EP 0334817 A1 9/1989
(Continued)

OTHER PUBLICATIONS

International Search Report issued in PCT/EP2015/059865, dated Aug. 28, 2015 (2 pages).
(Continued)

*Primary Examiner* — Justin Jonaitis
*Assistant Examiner* — Gustavo Hincapie Serna
(74) *Attorney, Agent, or Firm* — Osha Liang LLP

(57) ABSTRACT

The invention concerns a header (10) for a heat exchanger of a motor vehicle, configured to receive heat exchange tubes (12). The header comprises:

Figure 1:
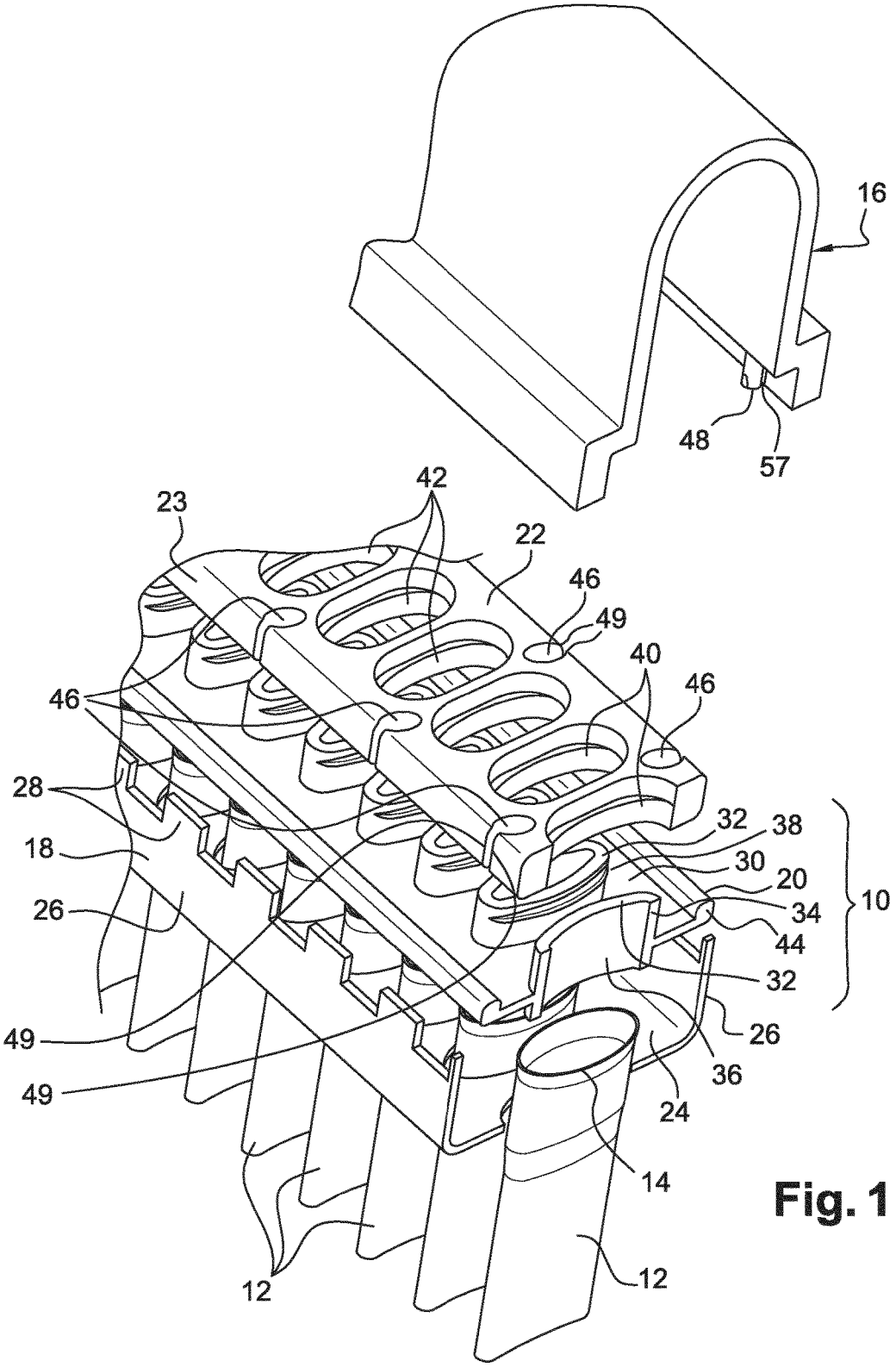

- a metal plate (18) through which the tubes (12) pass and which has two longitudinal edges (26) for crimping of the header (10) to a header box (16), and
- a plate (22) comprising a polymer material placed above the metal plate (18) and provided with openings (42) for receiving the tubes (12).

11 Claims, 2 Drawing Sheets

(51) Int. Cl.
*F28F 21/06* (2006.01)
*F28F 1/02* (2006.01)

(52) U.S. Cl.
CPC ..... *F28F 2225/08* (2013.01); *F28F 2230/00* (2013.01); *F28F 2275/122* (2013.01)

(58) Field of Classification Search
CPC ..... F28F 9/0202; F28F 9/0204; F28F 9/0207; F28F 9/0209; F28F 9/0212; F28F 2009/0285; F28F 9/04; F28F 9/12; F28F 9/165; F28F 2275/00; F28F 2275/122; F28D 1/05308; F28D 1/05316; F28D 1/05358; F28D 1/05366; B23P 15/26
USPC ..... 165/148, 149, 153, 162, 172, 173, 178
See application file for complete search history.

(56) References Cited

U.S. PATENT DOCUMENTS 4,546,823 A * 10/1985 Melnyk ..... F28F 9/0226 165/149
4,649,628 A * 3/1987 Allemandou ..... F28F 9/0226 165/148
4,848,448 A * 7/1989 Kaarre ..... F28F 9/0219 165/158
5,123,482 A * 6/1992 Abraham ..... F28D 1/0535 165/173
5,195,581 A * 3/1993 Puntambekar ..... F28F 9/0226 156/91
5,195,582 A * 3/1993 Haase ..... F28F 9/0226 165/149
5,311,934 A * 5/1994 Potier ..... F28D 1/05316 165/149
5,355,944 A * 10/1994 Potier ..... F28D 1/053 165/149
5,758,721 A * 6/1998 Letrange ..... F28F 9/0226 165/149
5,816,316 A * 10/1998 Hoffnung ..... F28F 9/0224 165/76
6,296,051 B1 * 10/2001 Sahnoun ..... F28F 9/0226 165/153
7,210,520 B2 * 5/2007 Yamanaka ..... F28F 9/02 165/153
7,640,971 B2 * 1/2010 Kolb ..... B21D 53/08 165/149
2015/0096725 A1 * 4/2015 Holmes ..... F28F 9/0226 165/151

FOREIGN PATENT DOCUMENTS

FR 2 783 907 A1 3/2000
FR 2 968 389 A1 6/2012
GB 1302407 A 1/1973
WO 2009/058395 A2 5/2009

OTHER PUBLICATIONS

Written Opinion of the International Searching Authority issued in PCT/EP2015/059865, dated Aug. 28, 2015 (5 pages).
Notification of Reasons for Refusal issued in corresponding Japanese Patent Application No. 2016-566713, dated Jan. 16, 2018 (9 pages).
Notification of Reason for Refusal issued in corresponding Korean Patent Application No. 10-2016-7031807, dated Feb. 2, 2018 (11 pages).

* cited by examiner

HEADER FOR A HEAT EXCHANGER OF A MOTOR VEHICLE

The invention relates to the field of heat exchangers, in particular for motor vehicles. More precisely, the invention concerns a header for a heat exchanger, comprising a bundle of tubes and at least one header box, also called a water box.

In general, the header holds the tubes via tube receiving openings which are openings made at regular intervals in the header, these intervals defining a tube spacing.

In order to improve the thermal exchange performance of the exchanger, the tube spacing can be reduced, which allows the header to hold a greater number of tubes.

It is known that an aluminum header cannot hold as many tubes as a steel header, since the tube spacing cannot be reduced below a certain value. This is because the mechanical strength of an aluminum header must be sufficient to resist the pressure of a heat-conducting fluid during normal use of the exchanger, and hence the thickness of the aluminum of such a header must not be less than 1.2 millimeters. Since this type of header is made by deep drawing, if the aluminum thickness is greater than or equal to 1.2 mm, it is not possible to reduce the tube spacing. In fact it is not possible to produce a deep-drawing die which allows a reduced tube spacing combined with a thickness greater than or equal to 1.2 mm, since in this case there would not be sufficient space left between the tube receiving openings for the material of the die.

Document WO 2009/058395 for example describes a header which comprises a tube receiving portion made of aluminum, which also serves as a header box and comprises a plastic reinforcement. This reinforced header allows a reduction in the thickness of the material used for the header and the tubes.

However, the header of the prior art does not allow a sufficient reduction in the tube spacing to allow a greater number of tubes to be accommodated, with the aim of improving the thermal efficiency of the exchanger. Thus the header of the prior art does not allow the exchanger to achieve optimum thermal performance.

Also, because this header comprises substantial ribbing on the header box in order to be able to withstand the internal pressure of the exchanger, this solution of the prior art is complex and costly to produce, and increases the global mass of the exchanger.

The object of the present invention is to remedy the above-mentioned drawbacks in particular by proposing a header able to receive a greater number of tubes, and the mass of which is reduced.

To this end, the object of the invention is a header for a heat exchanger of a motor vehicle, configured to receive heat exchange tubes, comprising:

- a metal plate through which the tubes pass and which has two longitudinal edges for crimping of the header to a header box, and
- a plate comprising a polymer material placed above the metal plate and provided with openings for receiving the tubes.

In the description below, the term "polymer plate" means the plate comprising a polymer material. Thus the above-mentioned header is reinforced by the polymer plate, which allows the use of a metal plate of aluminum, with a thickness of less than 1.2 mm. Advantageously, the reduction in thickness of the metal plate of the header allows its production by deep drawing, while reducing the tube spacing to values similar to those found on steel headers. Thus such a header can receive a greater number of heat exchange tubes.

The result is an improvement in the thermal efficiency of the exchanger, while the mass of the header is reduced. Furthermore, since the polymer plate reinforces the pressure resistance and improves the seal between the tubes, such a header is less subject to faults such as leakage of heat-conducting fluid for example. In fact, such a header improves the reliability and service life of the exchanger.

The term "placed above" means that the polymer plate is situated above the metal plate, without however being in direct contact therewith. Thus it is understood that a sealing gasket may be interposed between these two plates placed above each other.

It is specified that the receiving openings are openings for the passage of tubes through the plate, through which the tubes must pass.

The header may also comprise one or more of the following characteristics taken alone or in combination.

A wall of the polymer plate is configured such that the ends of the tubes terminate flush with this wall. Thus the tubes do not protrude from the polymer plate and hence their ends do not protrude into the interior of the header box, which eliminates phenomena of turbulence in the fluid flow in the header box.

The polymer plate has a globally flat form and a thickness between 3 and 8 millimeters, preferably around 5 millimeters. Observation of this thickness range for the polymer plate significantly improves the mechanical strength of the header and also allows a reduction in thickness of the metal plate.

The polymer plate comprises stiffening means for the header box, said means preferably comprising receiving openings for studs arranged in the header box. Advantageously, the stiffening means reinforce the stability and cohesion of the header box relative to the header, which limits the risks of leakage of the exchanger.

A sealing gasket is arranged between the metal plate and the polymer plate. Advantageously, this gasket has the double sealing function, namely sealing between the tubes and the header, and sealing between the header and the header box. Also, the gasket serves as a connecting element between the two plates, which facilitates the operation of handling the header during assembly of the exchanger.

The gasket comprises a flat portion sandwiched between the metal plate and the polymer plate, and preferably provided with funnels configured to be slipped over the tubes. Such funnels improve the seal between the tubes and the tube receiving openings.

The gasket comprises a peripheral bead intended to form the seal between firstly the header box and secondly at least one of the two plates. Thus this bead avoids risks of leakage of the exchanger.

The tube receiving openings arranged on the polymer plate also comprise a shoulder for retaining the gasket, configured such that the gasket is pressed against said shoulder when a tube is received in the receiving opening. Thus the gasket is easier to position on the header and its position is permanently improved.

The invention also concerns a plate comprising a polymer material for a header as described above.

The invention also concerns a sealing gasket for a header as described above.

The invention also concerns a header box and a header as described above.

Figure 2:
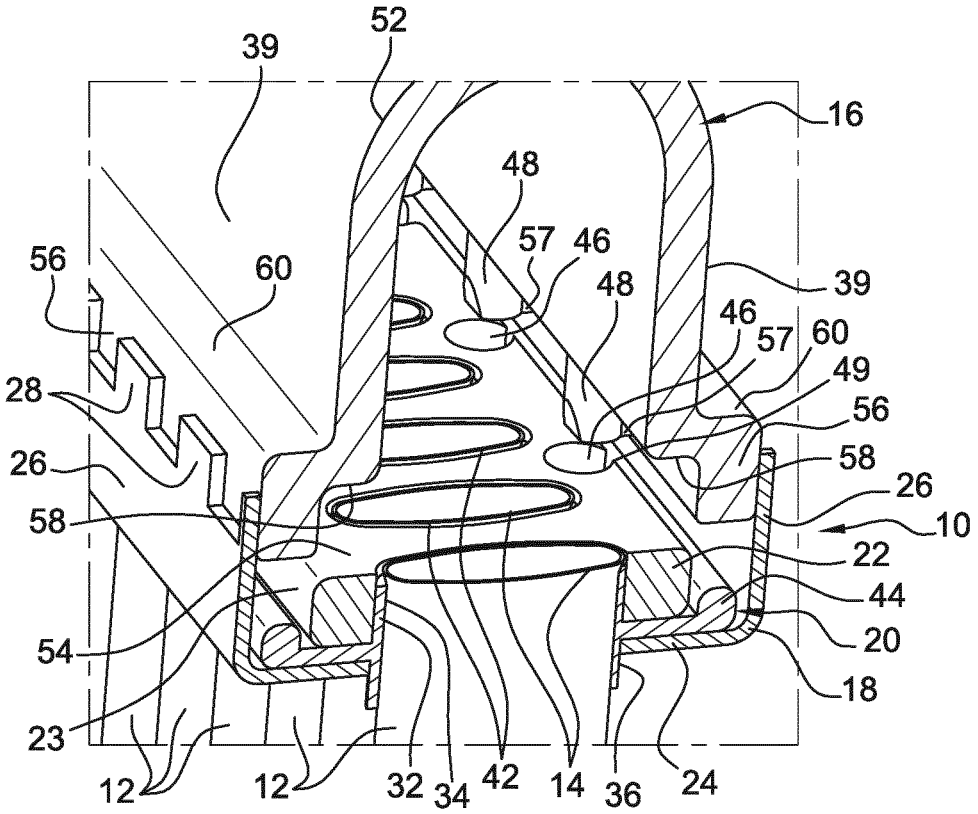

The invention will be better understood from viewing the attached drawings which are supplied as examples and have no limitative character, and in which:

FIG. 1 is a perspective view of a header according to a first embodiment, on which a tube bundle is arranged, FIG. 2 is a perspective view of a header according to a second embodiment.

With reference to FIG. 1, a header 10 is shown for a heat exchanger of a motor vehicle. In the example, the exchanger is a radiator equipped with a row of heat exchange tubes 12 intended to conduct a heat-carrying fluid into the exchanger. Alternatively, it could be another type of exchanger, such as for example a charge air cooler.

The header is configured to receive the exchanger tubes 12 by their ends 14, and to be assembled with a header box 16. In this example, the header 12 is formed by a metal plate 18, a sealing gasket 20 and a plate 22 of polymer material, referred to below as the polymer plate.

The tubes 12 are intended to pass through the metal plate 18 which is crimped onto the header box 16. To this end, the metal plate 18 is a deep-drawn sheet comprising a central rectangular facet 24 provided with regularly spaced, oval openings designed for passage of the tubes 12. The metal plate 18 has side facets forming longitudinal folded edges 26 and transverse folded edges (not shown) for crimping the header 10 to header box 16. These edges 26 comprise crimping teeth 28 of rectangular form which are intended to facilitate the operation of crimping of the metal plate 18.

The sealing gasket 20 is arranged between the metal plate 18 and the polymer plate 22. To this end, it comprises a flat portion 30 sandwiched between the metal plate and the polymer plate. This flat portion 30 of rectangular shape is provided with funnels 32 configured to be slipped over the tubes 12. These funnels 32 are oval in form and protrude on either side of the flat portion 30 of the gasket, i.e. they comprise upper parts 34 protruding opposite the header box 18, and lower parts 36 protruding below the flat portion of the gasket. The funnels 32 comprise lips 38 arranged on the side walls of the upper parts 34. These lips 38 are intended to come to rest on a shoulder 40 arranged in the tube receiving openings 42 of the polymer plate. Thus firstly they form support surfaces facilitating positioning of the gasket, and secondly they participate in a seal between the header box and the header.

The gasket comprises a peripheral bead 44 intended to form the seal between firstly the header box 16 and secondly at least one of the two plates 18, 22. The gasket is made of an elastomer material conventionally used in heat exchangers and well known to the person skilled in the art.

The polymer plate 22 is placed above the metal plate 18 for receiving the tubes. The tube receiving openings 42 have an oblong contour, while the shoulders 44 retaining the gasket 20 have a substantially oval form. Each shoulder 40 is configured such that the lip 38 of the gasket is pressed against the shoulder 40 when a tube 12 is received in a receiving opening 42. In the example, the tubes are slightly flared at their ends 14, which improves the contact of the funnel 32 of the gasket against the shoulder 40.

The polymer plate 22 comprises stiffening means 46, 48 of the header box 16, these means comprising, along each edge of the plate 22, rows of receiving holes for stiffening studs 48 arranged in the header box 16. Each hole opens laterally into the side face 23 of the polymer plate 22, forming a slot. The edges 49 of the slot are separated by a distance which is smaller than the diameter of each opening. It is understood that these openings are shaped so that the stiffening studs 48 cannot be withdrawn laterally from the polymer plate 22, and are held perpendicular to the plate 22.

The stiffening means are thus configured to better resist the forces of traction and rotation induced when the side walls 39 of the header move apart under the effect of the pressure of the fluid inside the exchanger. Thus there are fewer distortions of the header box 16, and the number of reinforcing ribs to improve the rigidity can be substantially reduced.

To produce the polymer plate 22, a thermosetting polymer material is recommended, but other alternatives comprising thermoplastics or composite materials could also be considered. The thickness of the polymer plate 22 is between 3 and 8 mm and preferably around 5 mm.

The header box 16 forms a cover on the top of the header. It is made from a thermosetting material. A portion 52 of the header box 16 opposite an upper wall 54 of the polymer plate 22 has a profile of a half-cylinder to resist the fluid pressure. This semicylindrical part 52 of the header box is extended on its sides by side walls 39, each comprising a step 56, also called a "curb" by the person skilled in the art. Inside the header box 16, the step 56 delimits an inner shoulder 58 which is intended to come to rest on the polymer plate 22. The inner shoulder 58 carries the stiffening studs 48 oriented towards the polymer plate. Each stud is connected to the step 56 by a strip of material 57, forming an inner stiffening rib for the header box 16. This strip of material 57 is intended to be able to pass through one of the slots 49. Outside the header box 16, the step 56 forms an outer shoulder 60 intended to receive the crimping teeth 28 when folded after the crimping step.

Because the header is reinforced by the polymer plate 22, but also because of the presence of the stiffening means 46, 48 of the header box, it is possible to optimize (reduce or eliminate) the number of reinforcing ribs.

The top of the flat portion 30 of the gasket receives the polymer plate 22 with the funnels 32 which surround the heat exchange tubes 12, and the peripheral bead 44 which surrounds the polymer plate 22. More precisely, the funnels 32 protrude above the gasket 20 and surround the ends 14 of the tubes 12, terminating flush with the upper wall 54 of the polymer plate 22. This upper wall 54 is configured such that the ends 14 of the tubes—like the funnels 32—terminate flush with this wall.

According to a second embodiment shown in FIG. 2, the exchanger tubes have straight ends i.e. without a retaining flare, i.e. a widening of the tubes intended to prevent slippage of said tubes towards the outside of the header box 60. With regard to the polymer plate, this comprises openings with a contour corresponding over the entire height to the oval profile of the tubes, i.e. the openings of the plate have no shoulder. Consequently, the upper parts of the funnels of the gasket have a profile identical to that of the tubes and have no lip. This embodiment—of simpler design—lowers the production costs of the exchanger.

The header 10 is not limited to the embodiments shown, and other embodiments will appear clearly to the person skilled in the art. In particular, the general shape of the polymer plate 22 may be varied. Since this is molded, it is relatively easy to ensure that it comprises volumetric shapes or reliefs intended for example to simplify the positioning of the tubes 12 in the receiving openings 42. Also, to further simplify production, it could also be considered not to provide stiffening means 46, 48, but in this case the header box will have to be provided with additional ribs.

The invention claimed is:

1. A header for a heat exchanger of a motor vehicle, configured to receive heat exchange tubes, the header comprising:

a first metal plate through which the tubes pass, comprising:

two longitudinal edges for crimping of the header to a header box; and a second plate, placed above the first metal plate, comprising:

a polymer material, openings for receiving the tubes, and stiffening means for the header box; wherein said stiffening means comprises receiving openings for studs; the studs being arranged in the header box.

2. The header as claimed in claim 1, wherein a wall of the second plate is configured such that the ends of the tubes terminate flush with the wall.

3. The header as claimed in claim 1, wherein the second plate has a flat form and a thickness between 3 and 8 millimeters.

4. The header as claimed in claim 1, comprising a sealing gasket arranged between the first metal plate and the second plate.

5. The header as claimed in claim 4, wherein the sealing gasket comprises a flat portion sandwiched between the first metal plate and the second plate, and provided with funnels configured to be slipped over the tubes.

6. The header as claimed in claim 4, wherein the sealing gasket comprises a peripheral bed intended to form the seal between the header box and the first metal plate or the second plate.

7. The header as claimed in claim 4, wherein the openings comprise a shoulder for retaining the sealing gasket, configured such that the sealing gasket is pressed against the shoulder when a tube is received in one of the openings.

8. A polymer plate for the header as claimed in claim 1.

9. A sealing gasket for the header as claimed in claim 4.

10. A heat exchanger comprising the header box and the header as claimed in claim 1.

11. A header for a heat exchanger of a motor vehicle, configured to receive heat exchange tubes, the header comprising:

a first metal plate through which the tubes pass, comprising:

two longitudinal edges for crimping of the header to a header box;

a second plate, placed above the first metal plate, comprising:

a polymer material, and openings for receiving the tubes; and a sealing gasket arranged between the first metal plate and the second plate, wherein the openings comprise a shoulder for retaining the sealing gasket, configured such that the sealing gasket is pressed against the shoulder when a tube is received in one of the openings.

* * * * *